US005161601A

United States Patent [19]

Abis et al.

[11] Patent Number: 5,161,601

[45] Date of Patent: Nov. 10, 1992

[54] PROCESS AND RELEVANT APPARATUS FOR THE INDIRECT CASTING OF BILLETS WITH METAL ALLOY IN SEMI-LIQUID OR PASTE-LIKE STATE

[75] Inventors: Sergio Abis, Novara; Fulvio Calzi, Caselette, both of Italy

[73] Assignee: Stampal, S.p.A., Caselette, Italy

[21] Appl. No.: 681,335

[22] Filed: Apr. 5, 1991

[30] Foreign Application Priority Data

Apr. 12, 1990 [IT] Italy ..... 20018 A/90

[51] Int. Cl.[5] ..... B22D 1/00

[52] U.S. Cl. ..... 164/485; 164/443; 164/348; 164/900; 164/500

[58] Field of Search ..... 164/122, 485, 71.1, 164/900, 443, 348, 500

[56] References Cited

U.S. PATENT DOCUMENTS 4,621,676 11/1986 Steward ..... 164/900
4,709,746 12/1987 Young et al. ..... 164/485

FOREIGN PATENT DOCUMENTS 2037634 7/1980 United Kingdom .
2042386 9/1980 United Kingdom .
2080692 2/1982 United Kingdom .

*Primary Examiner*—Kuang Y. Lin
*Attorney, Agent, or Firm*—Collard & Roe

[57] ABSTRACT

Process for casting billets with the metal alloy being in the liquid or paste-like state, which process consists of pouring the liquid alloy into a casting tank, then transferring it, by means of an electromagnetic-induction pump, to a mixer-cooler, preferably of static type, so as to obtain at the outlet of the latter an alloy in the semi-liquid state, and finally feeding said alloy directly to a traditional system for billet casting.

4 Claims, 2 Drawing Sheets

Figure 1:
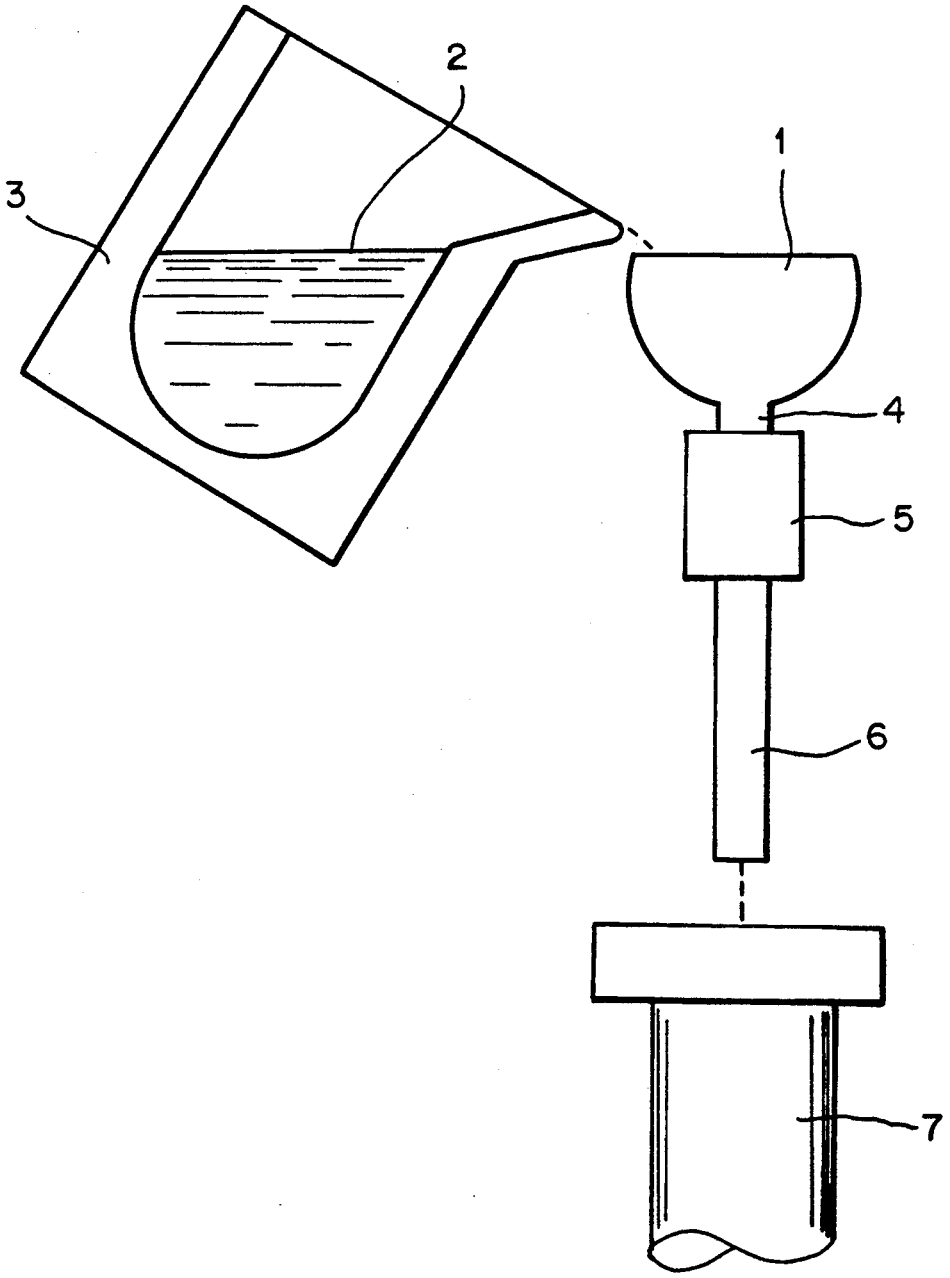

PROCESS AND RELEVANT APPARATUS FOR THE INDIRECT CASTING OF BILLETS WITH METAL ALLOY IN SEMI-LIQUID OR PASTE-LIKE STATE

DESCRIPTION

The present invention relates to a process for the indirect casting of billets into continuously cooled moulds, which process uses such metal alloys as Al, Cu, Mg alloys, and the like, in the semi-liquid or paste-like state, in order to obtain billets having a homogeneous structure, and free from defects. Also a special apparatus to practice said process falls within the present invention.

As known, the present techniques for billet casting are classified on the basis of the modalities according to which the liquid metal, or the liquid metal alloys, are obliged to fill the hollow inside a mould (such as an ingot mould, or the like). In the particular case of the indirect vertical casting, the liquid metal is first poured into a casting tank from which it flows, through one or more channel(s), to fill, by gravity, the hollow inside the mould, kept continuously cooled. It is also known that the casting of billets by means of metal alloys in the liquid state, in particular high-hardness alloys, normally requires rather long cooling times and causes considerably large scrap amounts to occur, owing to the presence, in the solidified formed articles, of cracks, fractures and other faults.

A purpose of the instant invention is of providing a process for billet casting, which is capable of yielding billets made from metal alloys of even high hardness, and special metal alloys, free from such faults as cracks, fractures, deformations and the like, with a highly homogeneous structure and shorter solidification times. Another purpose of the invention is of providing a particular apparatus simple and practical to accomplish and to be operated, suitable for practicing said casting process.

These and still other purposes, which are set forth more clearly from the following disclosure, are achieved by a process for casting billets of metal alloys, which process consists, according to the instant invention, of pouring the liquid alloy into a casting tank, then transferring it, by means of an electromagnetic-induction pump or the like, to a controlled-fluid-circulation mixer-cooler apparatus, so as to obtain, at the outlet of the latter, an alloy in the semi-liquid or paste-like state, and finally feeding said alloy in paste-like state directly to a traditional system for billet casting.

Said process preferably uses a mixer-cooler of static type, preferably of the type having the shape of a stationary box-like body equipped with means suitable for creating a plurality of mixing channels intercommunicating with one another, orientated in various directions and continuously cooled.

In order to practically implement said process, the present invention provides a casting apparatus comprising a usual casting tank, fed with liquid alloy, to whose casting tube, applied at its bottom, a pump of the electromagnetic-induction pump type is connected, which feeds the liquid alloy to a static mixer-cooler of modular type, with a plurality of continuously cooled mixing channels, suitable for causing said liquid alloy to partially solidify, so as to cause it to change to semi-liquid or paste-like state, and a usual system of cooled moulds for producing billets or similar formed articles.

Figure 2:
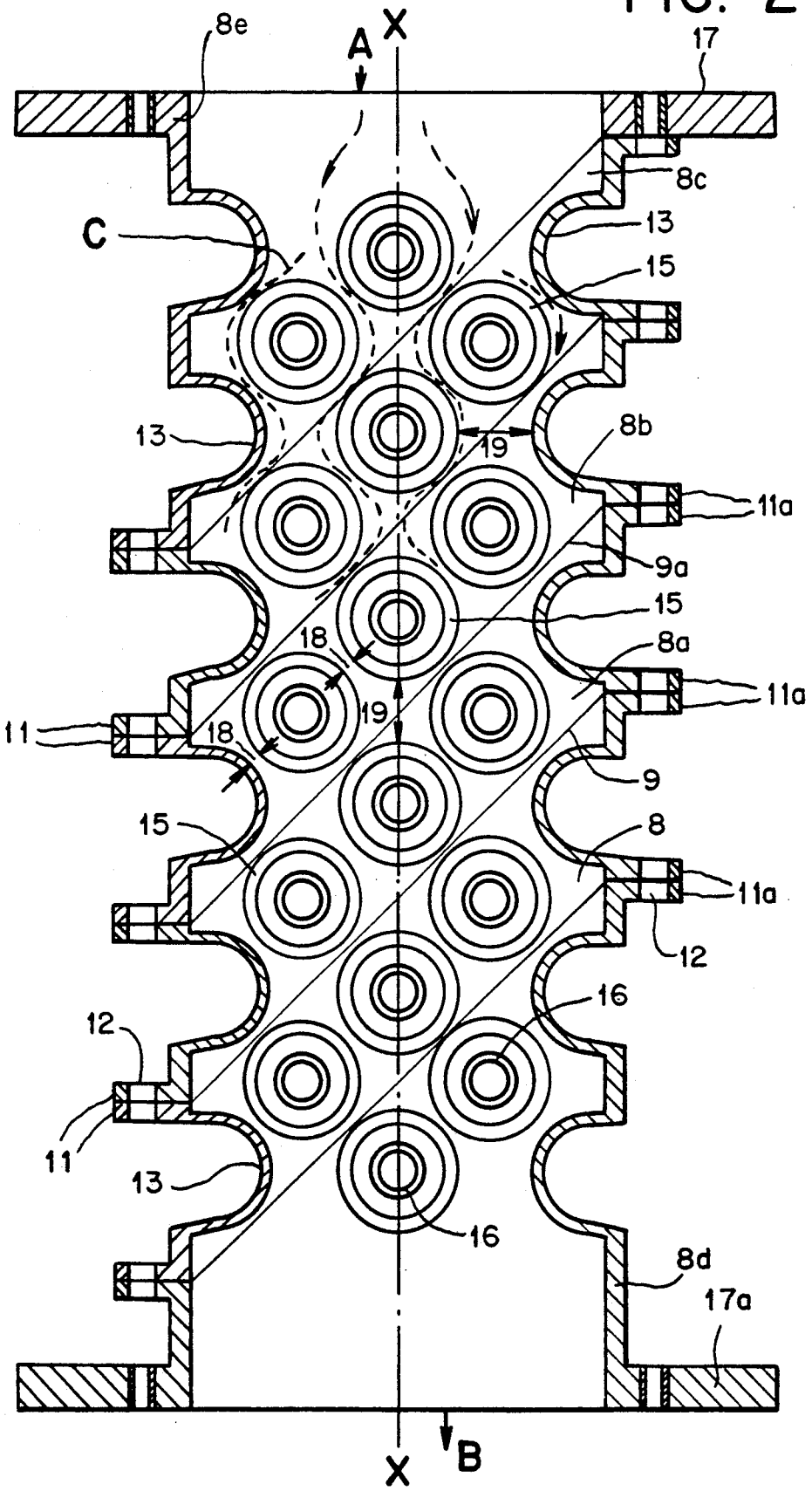

Further features and advantages of the present invention will be set forth by the following disclosure in detail of a preferred, non-exclusive form of practical embodiment, which disclosure is made by referring to the accompanying drawing sheets, supplied for merely indicative, non-limitative purposes, in which:

FIG. 1 shows, in schematic form, the structural elements which compose the apparatus for practicing the process of the invention; and FIG. 2 shows, in plan view, a static mixer apparatus used to cause the liquid alloy used as the starting material, to change into the semi-liquid state.

Referring to such figures, and, in particular, to FIG. 1, the casting apparatus suitable for practicing the process of the invention, is substantially constituted by a casting tank 1 into which the liquid alloy 2 is periodically poured by means of a ladle 3. From the vertical casting duct 4, the liquid alloy is fed, by gravity, into a pump 5 of the electromagnetic-induction pump type, the function of which is of enabling the alloy to overcome the pressure drops, always rather high, due to the cooling inside a mixer-cooler 6, which the same alloy undergoes while it flows through the same mixer, and to the consequent passage into the paste-like state. The alloy leaving the mixer 6, which alloy is now in the semi-liquid or paste-like state, is directly fed to a traditional system 7, to form one or more cast billet(s).

In particular, the mixer-cooler 6 is of static type, and preferably is of the type shown in FIG. 2. Said mixer-cooler is constituted by the coupling, in the longitudinal direction, of a plurality of elongated box-like bodies indicated with the numerals 8–8*a*–8*b*–8*c* etc., each of which is defined by the peripheral lines 9–9*a*, which indicate the sides along which the various bodies are coupled. The hollow bodies 8–8*a* etc. are modular, because they are made with same dimensions, and can be coupled in two opposite positions.

More precisely, each modular, box-like body is constituted by a container of parallelepipedal shape provided, at its opposite ends, with a pair of flanges 11–11*a*, with bores 12 for said body's coupling—in stack fashion—with other equal bodies. Each box-like body is furthermore open at both its opposite longitudinal faces (corresponding to the coupling lines 9–9*a*), whilst the front faces are closed by inwards arcuate walls, as indicated with 13. Perpendicularly to the opposite closed faces of each body, through-tubes or sleeves 15 are inserted, which are provided with inlet openings 16, preferably threaded and connected with an external source of coolant fluid kept continuously circulated under controlled conditions, such as, e.g., water atomized by pressurized air. A plurality of said modular hollow bodies 8–8*a*–8*b* etc. are then assembled together by juxtaposing the opposite open faces of said individual bodies to each other, and then fastening the individual bodies to each other, in stack form, with tightly sealed couplings, by means of tie-rods inserted through the individual bores of said pairs of flanges 11–11*a*. The stack of modular elements is closed at its opposite ends by a modular element (8*d* and 8*e*), of substantially triangular shape and so contoured as to constitute an inlet "A" and an outlet "B" for the metal alloy to be processed; each of said opposite elements furthermore has a large flange 17 and 17*a*, to which the tie-rods (not depicted), which keep fastened the stack of modular bodies, are stably anchored. Furthermore, the individual modular bodies are arranged in diagonal layout relatively to the direction of feed "A" of the liquid alloy. In this way, the individual tubes 15 of each modular body are staggered, and closer, to each other. This arrangement enables the arcuate end walls 13 to enter the space between, and come close to, the outermost tubes, consequently behaving as if they were portions of tubes 8. This arrangement in stack fashion makes it possible a large single hollow to be created, which is constituted by the total of the hollows of the various side-by-side box-like bodies fastened to each other by tightly-sealed couplings, whilst the presence of the plurality of cooling tubes 15 creates, inside said single hollow, passageways (for the alloy fed from the inlet "A") having cross-sections 18 with surface-areas different from the surface-areas of the other passageways 19 between adjacent tubes. Thus, by placing the cooling tubes in different relative positions, and varying the number of tubes provided in each modular element, one can create a plurality of mutually intercommunicating mixing channels with different dimensions and according to different directions, such as to enable the liquid alloy, fed at the end "A", to flow with a high shear gradient, without turbulence, and also to undergo high induced shear stresses, during its cooling, such as to prevent branched dendritic crystals from growing up and aggregating. The path of the molten alloy, fed at the inlet "A" of the apparatus, is partially illustrated with chain lines, as indicated with "C".

Furthermore, the above disclosed apparatus can be used in either vertical or horizontal direction; furthermore, the whole casting apparatus can be arranged in a horizontal position, in order to reduce its overall encumbrance.

In practice, the process and relevant apparatus according to the present invention make it possible billets to be obtained with an extremely homogeneous structure, whilst the cooling of the billets is highly reduced, in that the alloy charged to the casting moulds is already at its solidification threshold.

Obviously, the above process can be accomplished by using other types of static mixer-coolers, together with an electromagnetic-induction pump.

We claim:

1. A process for casting a metallic alloy in semi-liquid or paste-like state, comprising:

(a) forcing a molten metallic alloy by means of an electromagnetic induction pump to flow into a mixer-cooler, with a high shear gradient, without turbulence, and undergoing high induced shear stresses;

(b) cooling the flow of molten alloy within said mixer-cooler while undergoing said shear stresses, thereby causing said molten alloy to partially solidify and obtaining, at the outlet of said mixer-cooler, an alloy in the semi-liquid or paste-like state; and (c) feeding said alloy in the paste-like state to a billet casting system, thereby obtaining billets having a homogeneous structure and being free from defects.

2. A process for casting a metallic alloy in paste-like state according to claim 1, wherein said mixer-cooler is of the static type.

3. An apparatus for casting a metallic alloy in semi-liquid or paste-like state, comprising:

(a) a casting tank containing a molten metallic alloy provided with a casting tube at its bottom;

(b) a static mixer-cooler of modular type, with a plurality of continuously cooled mixing channels suitable for causing said molten metallic alloy to partially solidify so as to cause said alloy to change into semi-liquid or paste-like state in said mixer-cooler;

(c) an electromagnetic-induction pump connected to said casting tube and feeding said molten metallic alloy to said static mixer-cooler, said electromagnetic pump functioning to enable said alloy which is partially solidified in paste-like state to overcome the pressure drops due to the flowing through said mixer-cooler; and (d) a casting system of cooled molds for producing billets to be fed with said alloy in paste-like state coming from said mixer-cooler.

4. An apparatus for casting a metallic alloy in paste-like state according to claim 3, wherein said static mixer cooler comprises:

a plurality of modular, hollow box-like elements coupled to one another with tight sealed couplings, each of which modular elements is formed by a box-like body substantially having the shape of an elongated parallelepiped, with two mutually opposite longitudinal open faces and positioned in diagonal layout relative to the direction of feed of the molten alloy;

tubes for cooling, said tubes being inserted transversely to said mutually opposite longitudinal open faces, which tubes are connected with an external source of controlled-circulation coolant fluid;

means for coupling said plurality of modular, hollow elements causing the open sides of each modular element to come to rest against each other;

means for fastening said modular elements to one another, with a tightly sealed coupling being opposite flanges with bores tightly joined and provided at the ends of each modular element, in such a way as to obtain one single hollow body inside of which the external surfaces of said cooling tubes define a plurality of mixing channels intercommunicating with one another and orientated in different directions, thus allowing the metal alloy in the liquid state, fed at an open end of said assembled single hollow body, to flow with a high shear gradient, simultaneously undergoing high shear stresses, during its cooling;

each box-like element having opposite ends, said opposite ends made as an inwardly arcuate head in order to define bent surfaces close, and substantially equal, to the surfaces of the adjacent cooling tubes; and said apparatus further comprising end modular elements in the structure having an external substantially triangular shape, in order to be capable of being coupled with the modular elements in the diagonal layout and constitute the inlet mouth for the molten alloy and constitute the outlet mouth for the alloy in paste-like state.

* * * * *